US011844415B2

(12) United States Patent
Mosley

(10) Patent No.: US 11,844,415 B2
(45) **Date of Patent: *Dec. 19, 2023**

(54) CORD SUPPORT AND METHOD OF MAKING AND USING SAME

(71) Applicant: Wendy Mosley, Sandy Hook, CT (US)

(72) Inventor: Wendy Mosley, Sandy Hook, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/970,922

(22) Filed: Oct. 21, 2022

(65) Prior Publication Data

US 2023/0042783 A1 Feb. 9, 2023

Related U.S. Application Data

(63) Continuation of application No. 17/069,511, filed on Oct. 13, 2020, now Pat. No. 11,478,065.

(51) Int. Cl.
*A45F 5/00* (2006.01)

(52) U.S. Cl.
CPC ..... *A45F 5/00* (2013.01); *A45F 2005/008* (2013.01); *A45F 2200/0575* (2013.01)

(58) Field of Classification Search
CPC ..... A45F 2005/026; A45F 2200/0575; A45F 5/021; A45F 2005/008; A45F 2200/0516; Y10T 24/1368; A61M 25/02; A61M 2025/0213; A61M 2025/026
USPC ..... 224/255–256, 269, 271–272, 219, 222, 224/250
See application file for complete search history.

(56) References Cited

U.S. PATENT DOCUMENTS

| | | | | |
|---|---|---|---|---|
| 1,482,647 | A * | 2/1924 | Gise | A45F 5/00 D19/135 |
| 3,878,849 | A | 4/1975 | Muller | |
| 4,445,894 | A | 5/1984 | Kovacs | |
| 4,970,631 | A | 11/1990 | Marshall | |
| 5,342,317 | A | 8/1994 | Claywell | |
| 5,901,930 | A * | 5/1999 | Harrel | F16L 3/01 248/51 |
| 5,941,856 | A | 8/1999 | Kovacs | |
| 6,261,231 | B1 | 7/2001 | Damphousse | |
| 6,419,660 | B1 * | 7/2002 | Russo | A61M 25/02 128/DIG. 26 |
| 6,443,347 | B1 * | 9/2002 | Elizalde | G06F 1/163 224/264 |

(Continued)

FOREIGN PATENT DOCUMENTS

CN 106725603 5/2017

OTHER PUBLICATIONS

Cone Instruments, www.coneinstruments.com, Product available before Mar. 13, 2019, 6 pp, Caledonia, Michigan, USA.

(Continued)

*Primary Examiner* — Adam J Waggenspack
(74) *Attorney, Agent, or Firm* — UConn IP Law Clinic; Curtis Rew; Henry Zinn

(57) ABSTRACT

A support for a hand-operated device is disclosed herein. The support comprises an arm band having an inner surface configured to surround and contact at least a portion of a user's forearm, and an opposite outer surface, and a cordholder attached to the arm band, the cordholder having a length extending diagonally relative to the length direction of the user's radius when the arm band is mounted on the user's forearm. A corresponding method is also disclosed.

18 Claims, 6 Drawing Sheets

(56) References Cited

U.S. PATENT DOCUMENTS

| | | | | |
|---|---|---|---|---|
| 6,645,185 | B2 | 11/2003 | Bird | |
| 7,465,360 | B2 | 12/2008 | Scribner | |
| 8,029,452 | B2 | 10/2011 | Kliewer | |
| 8,152,776 | B2 | 4/2012 | McCluskey | |
| 9,468,259 | B2 | 10/2016 | Ishida | |
| 10,062,364 | B1 * | 8/2018 | Amaral | A45F 5/00 |
| 2004/0077937 | A1 | 4/2004 | Yarden | |
| 2004/0084489 | A1 | 5/2004 | Murphey | |
| 2011/0301544 | A1 | 12/2011 | Dixon | |
| 2016/0183667 | A1 | 6/2016 | MacColl | |
| 2018/0135214 | A1 | 5/2018 | Sakai | |
| 2019/0330773 | A1 | 10/2019 | Hanson Allen | |

OTHER PUBLICATIONS

Carmel Murphy and Russo, An Update on Ergonomic Issues in Sonography, Employee Health and Safety Services (EHS) at Healthcare Benefit Trust (HBT) Project Report, Jul. 2000, p. 1-14, Vancouver, BC, Canada.

Marveen Craig, Sonopgrahy: An Occupational Health Hazard?, Journal of Diagnostic Medidcal Sonopgrahy, May/Jun. 1985, p. 121-126, vol. 1, SAGE Publishing, Thousand Oaks, CA US.

Val Gregory Mir, Musculoskeletal Injuries: An Occupational Health and Safety Issue in Sonopgrahy, Sound Effects Journal, Sep. 1998, p. 1-5.

* cited by examiner

CORD SUPPORT AND METHOD OF MAKING AND USING SAME

RELATED APPLICATIONS

This application is a continuation of U.S. application Ser. No. 17/069,511 filed on Oct. 13, 2020.

BACKGROUND

This disclosure relates generally to cord supports, and more particularly to cord supports mounted on an arm.

Hand-held electrical devices such as ultrasound probes and dental drills often receive power through a heavyweight electrical cord. When an operator spends multiple hours per day using the device, the weight of the cord can result in repeated forces of stress to the hand and/or wrist, which in turn can lead to carpal tunnel syndrome.

It would be useful to develop an apparatus that reduces the strain and provides ergonomic support during hand-operated electrical equipment operations.

SUMMARY

The disclosed embodiments provide a support for a hand-operated device. The support eliminates or reduces occupational stress and strain on the hand or wrist, which is believed to be a primary cause of carpal tunnel syndrome.

One embodiment described herein is a support for a hand-operated device, the support comprising an arm band having an inner surface configured to surround and contact at least a portion of a user's forearm, and an opposite outer surface; and a cordholder attached to the arm band, the cordholder having a length extending diagonally relative to the length direction of the user's radius when the arm band is mounted on the user's forearm.

In embodiments, the arm band includes a distal end portion, a proximal end portion, and a central longitudinal axis extending from the distal end portion to the proximal end portion. The cordholder and arm band form an elongated cord-receiving opening configured to support a cord utilizing the length of the cordholder rather than the width, thereby spreading the load of the cord to reduce wrist strain when the arm band is mounted to the user's forearm. In some cases, the cordholder is attached to the outer surface of the arm band. In embodiments, the cordholder has a first inner surface configured to contact a first segment of an electrical cord. In certain cases, the outer surface of the arm band includes a cord-contacting portion configured to contact the first segment of the electrical cord when the electrical cord is supported in the cord-receiving opening. In embodiments, the combination of the first inner surface of the cordholder and the cord-contacting portion of the arm band surround the entire circumference of the first segment of the electrical cord. In some embodiments, the interior surface of the arm band comprises an exterior layer with a static coefficient of friction between 0.8 to 1.2 μs when dry to achieve grip against the user's arm.

Another embodiment described herein is an arm band adapted to engage part of a user's arm having an attached cordholder extending at an angle relative to the direction of the length of the user's forearm.

Yet another embodiment described herein is a method for supporting a hand-operated instrument adjacent to a subject, comprising the steps of providing a supportive arm band having an inner surface adapted to engage a user's arm, and an opposite outer surface, and a cordholder configured to be attached to the arm band; positioning the arm band in contact with the circumference of the user's arm; connecting the cordholder to the arm band; and securing a cord connected to the instrument in an opening of the cordholder. In some cases, the method further comprises the step of using the instrument while the cord is ergonomically supported by the cordholder.

A further embodiment described herein is a support for a hand-operated device, the support comprising an arm band having an inner surface configured to surround and contact at least a portion of a user's forearm, and an opposite outer surface; and a cordholder attached to the arm band, the cordholder having a length extending diagonally relative to the central longitudinal axis of the arm band, and a width extending in a direction perpendicular to the length, the cordholder and arm band forming an elongated cord-receiving opening configured to support a cord utilizing the length of the cordholder rather than the width, thereby spreading the load of the cord to reduce wrist strain when the arm band is mounted to the user's forearm.

Yet another embodiment described herein is an arm band with an inner surface configured to surround and contact at least a portion of a user's lower arm, and an opposite outer surface, the arm band further including a distal end portion, a proximal end portion, a central longitudinal axis extending from the distal end portion to the proximal end portion, and a fastener to support the arm band surrounding the user's arm; a cordholder attached to the arm band, the cordholder having a length in the range of 8 cm to 21 cm, and extending diagonally relative to the central longitudinal axis of the band, and a width, the cordholder and band forming an elongated cord-receiving sleeve having two open ends, the sleeve configured to surround and support a cord utilizing the length of the cordholder rather than the width, thereby spreading the load of the cord to reduce wrist strain when the band is mounted to the user's arm.

In some embodiments, the cordholder attached to the outer surface of the arm band is removable.

BRIEF DESCRIPTION OF THE DRAWINGS

The drawings illustrate the design and utility of preferred embodiments, in which similar elements are referred to by common reference numerals.

DETAILED DESCRIPTION

Figure 1:
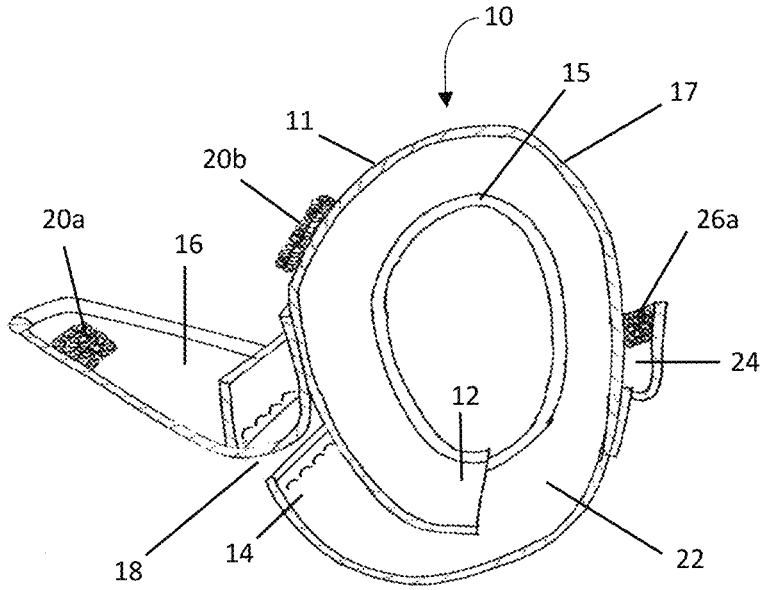
FIG. 1 shows a cross-sectional view in accordance with a first embodiment of the closed arm band.

The embodiments disclosed herein spread the load across the surface area of a arm band. The arm band can be used in all industries including but not limited to sonography, tattoo artistry, dentistry, and orthopedics to reduce occupational stress and strain on the hand or wrist and decrease the risk of carpal tunnel syndrome.

During examinations, the cord can dangle over the exam table or area of interest and tug on the probe. This can eventually create a nuisance because the user must readjust the cord each time it falls or becomes caught against another surface. The cordholder attached to the arm band manages the cord by preventing the cord from tugging on the probe while in use. This reduces possible distractions from the exam or current task. By steadying the probe or device and holding the cord out of the way, the cordholder promotes the user's imaging accuracy.

In some cases, the arm band comprises a thin sheath of flexible thermoplastic, thermoset, or fibrous material that is configured to contact the entire circumference of the user's arm.

As used herein, the term "unwrapped" means disengaged from the user's arm such that the arm band may lay flat during periods of non-use.

In some cases, the "cordholder" comprises a ring or strip of material permanently attached to the arm band on one side with the other side configured to be removably fastened by a closure mechanism. The cordholder, when closed around the respective equipment cord, holds such cord in place for the duration of use by the user.

A first embodiment, FIG. 1 through 7, shows a support 10 including a circumferential arm band 11 with a first end portion 12 having a closure flap 16 and a second end portion 14 having a slit 18. When the circumferential arm band 11 is closed around a user's arm, the distal end portion 15 is located toward the user's wrist and the proximal end portion 17 is located toward the user's elbow.

Referring now to FIG. 1 through 7, the first end portion 12 and second end portion 14 are coupled by sliding the closure flap 16 through the slit 18 and tightening the arm band to the user's satisfaction. In the illustrated embodiment, the slit 18 extends parallel to the axis of the unwrapped version of the circumferential arm band 11. The closure flap 16 is configured to be fastened to the intermediate portion 13 of the circumferential arm band 11 by way of mating hook and loop closure mechanisms 20*a* and 20*b*. The interior surface 21 of the circumferential arm band 11 has an inner lining 22 that comprises a high-friction material to achieve adequate grip. On the intermediate portion 13 of the circumferential arm band 11 is a cordholder 24, which is permanently connected to the arm band on one end and removably located to the same on the other end by way of a second hook and loop closure mechanism 26.

In embodiments, the cordholder 24 and an underlying portion 23 of the surface of the arm band 11 together form a channel 25 with a longitudinal opening 19 that is sized to tightly support an electrical cord therein. By tightly supporting the cord, the cordholder not only keeps the cord from obstructing or slowing the user's movement of the device, but also spreads the weight of the cord along a portion of the length of the user's forearm. This reduces strain on the user's hand and/or wrist.

Figure 2:
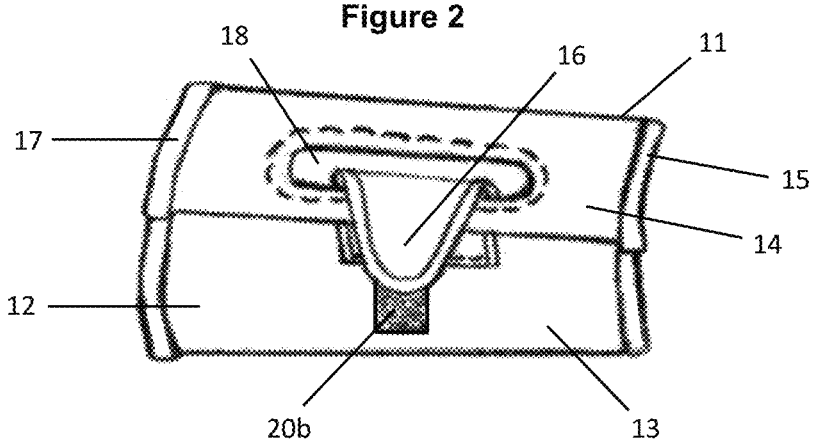
FIG. 2 is a first side-view of the first embodiment.

FIG. 2 illustrates the fully closed circumferential arm band 11 with first end portion 12 coupled to the second end portion 14. The closure flap 16 is fully engaged through the slit 18 and fastened to the mating hook and loop closure mechanism 20*b* on the intermediate portion 13 of the arm band.

Figure 3:
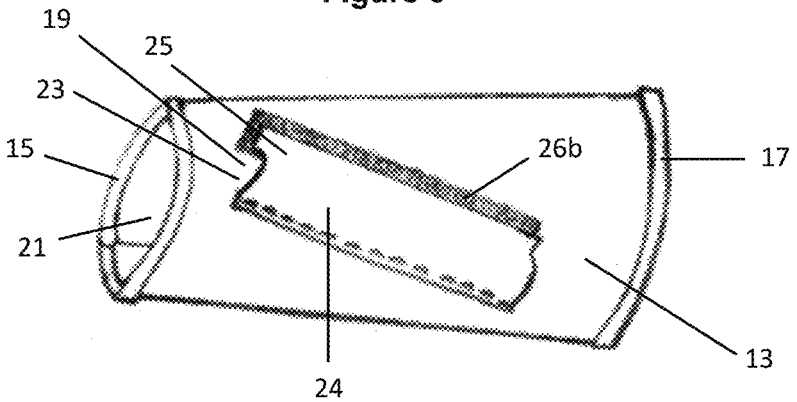
FIG. 3 is a second side-view of the first embodiment.

FIG. 3 shows another view of the fully closed circumferential arm band 11 with cordholder 24. The hook and loop closure mechanism 26*a* on the removably located end of cordholder 24 is fastened to the mating hook and loop closure mechanism 26*b* on the intermediate portion 13 of the arm band.

Figure 4A:
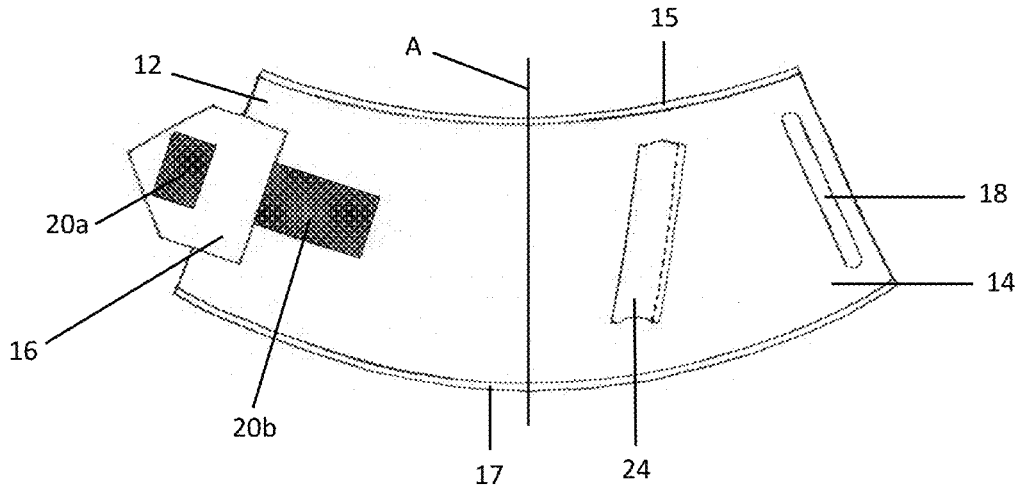
FIG. 4A depicts the first embodiment in an unwrapped configuration.

FIG. 4A shows the exterior surface of the fully unwrapped circumferential arm band 11 with the first end portion 12 and second end portion 14. The proximal end portion 17 radius of curvature tapers towards the shorter distal end 15 radius of curvature. The disengaged closure flap 16 contains a hook and loop closure mechanism 20*a*, which is configured to be fastened to a mating hook and loop closure mechanism 20*b*. The cordholder 24 extends lengthwise along the intermediate portion 13 of the arm band and slit 18 is depicted on the second end portion 14.

Figure 4B:
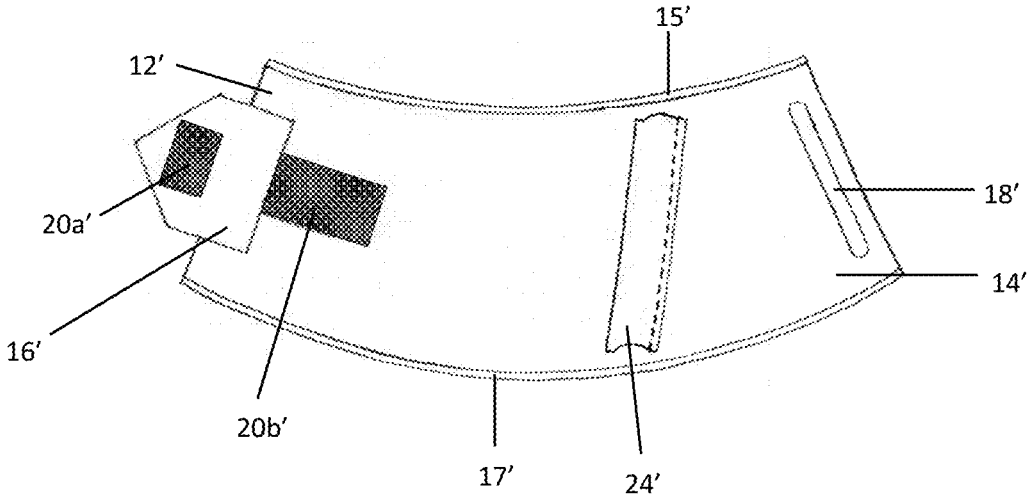
FIG. 4B depicts an alternative version of the first embodiment in an unwrapped configuration with a longer cordholder.

FIG. 4B shows an alternative embodiment of the exterior surface of the fully unwrapped circumferential arm band 11' where the cordholder 24' is longer than in embodiment of FIG. 4A. The cordholder 24' extends diagonally lengthwise from the distal end portion 15' to proximal end portion 17'. This embodiment includes a closure flap 16' at the first end portion 12' with a hook and loop closure mechanism 20*a*', which is configured to be fastened to a mating hook and loop closure mechanism 20*b*' when the closure flap 16' passes through slit 18'.

Figure 5:
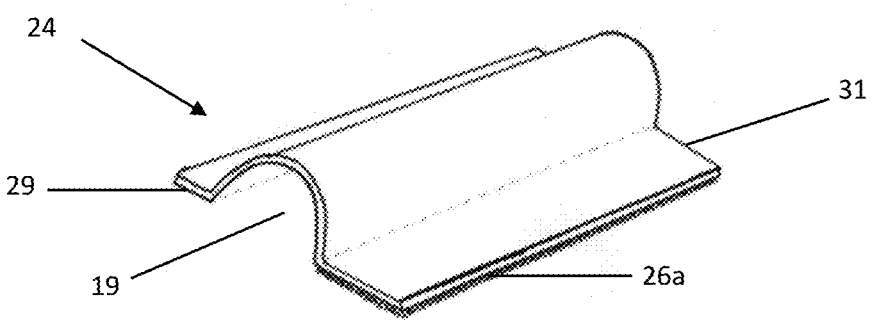
FIG. 5 shows a top view of the cordholder component in the first embodiment.
Figure 6:
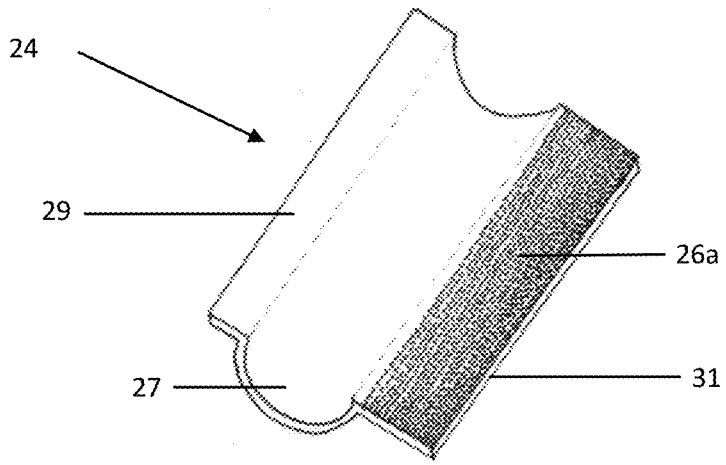
FIG. 6 shows a bottom view of the cordholder component in the first embodiment.

FIG. 5 shows the detail of the cordholder 24 with the hook and loop closure mechanism 26*a* on the removably located end. FIG. 6 illustrates a second view of the cordholder 24 with the hook and loop closure mechanism 26*a* on the removably located end. The cordholder 24 includes a cord-contacting portion with an inner surface 27 configured to directly contact an electrical cord, a first arm band-contacting portion with an inner surface 29 configured to be removably or permanently mounted to the arm band 11, and a second band-contacting portion with an inner surface 31 configured to be removably mounted to the arm band 11. This construction provides that the entire circumference of a portion of the electrical cord is contacted by either a surface of the arm band or a surface of the cordholder. The tight fit around the cord enables the weight of the cord to be distributed along the length of a portion of the user's forearm.

Figure 7:
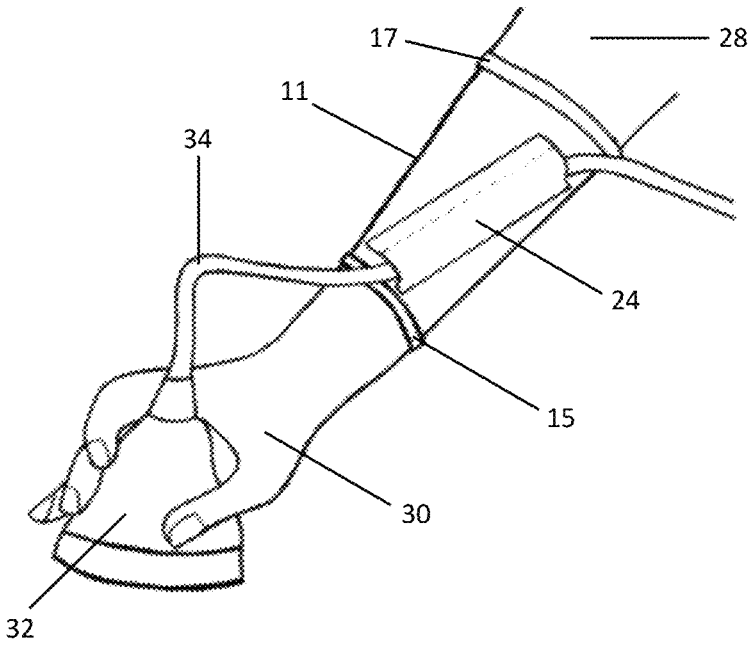
FIG. 7 shows the first embodiment as a closed arm band wrapped around user's arm with cordholder in downward direction.

FIG. 7 shows a perspective view of the circumferential arm band 11 while fully wrapped around the user's arm 28. The user's hand 30 holds an ultrasound probe 32 whose cord 34 is enclosed and stabilized by the cordholder 24. In this view, the cordholder 24 is angled downwardly in a direction toward the user's lower body.

Figure 8:
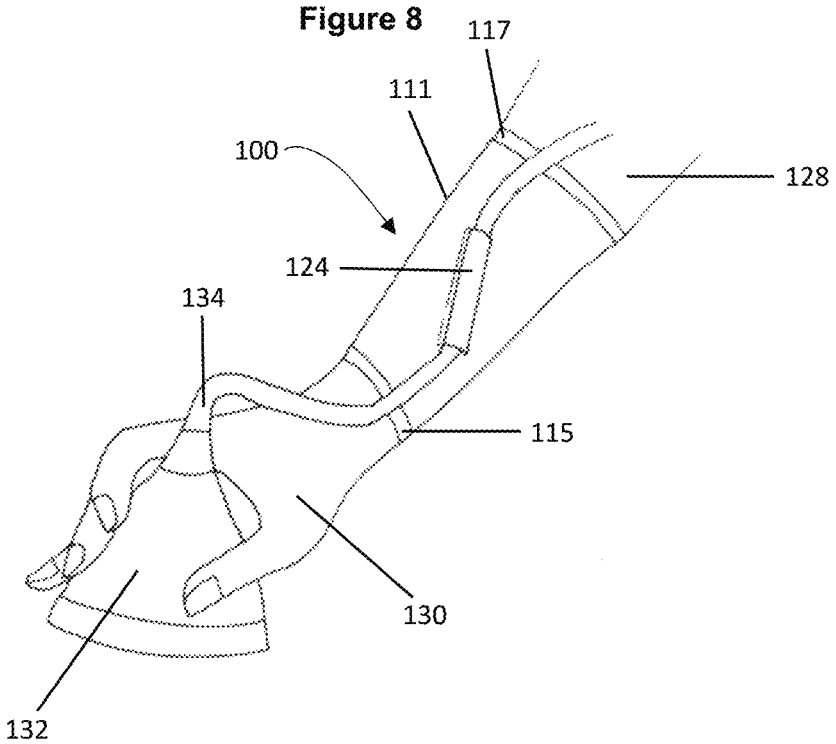
FIG. 8 shows a second embodiment as a closed arm band wrapped around user's arm with cordholder in upward direction.

In a second embodiment, FIG. 8 shows a perspective view of the circumferential arm band 111 while fully wrapped around the user's arm 128. The user's hand 130 holds an ultrasound probe 132 whose cord 134 is enclosed and stabilized by the cordholder 124. In this view, the cordholder 124 is angled upwardly in a direction toward the user's body.

Figure 9:
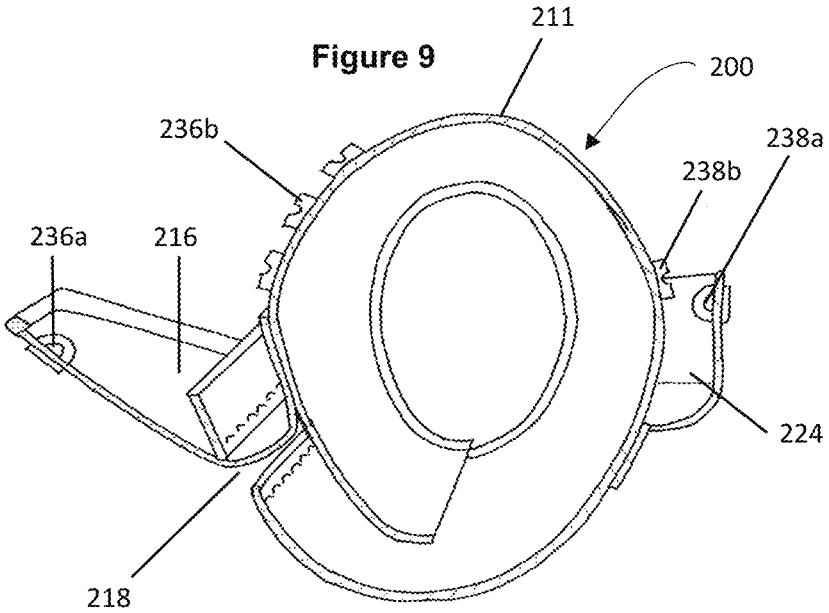
FIG. 9 shows a cross-sectional view in accordance with a third embodiment with a snap closure.
Figure 10:
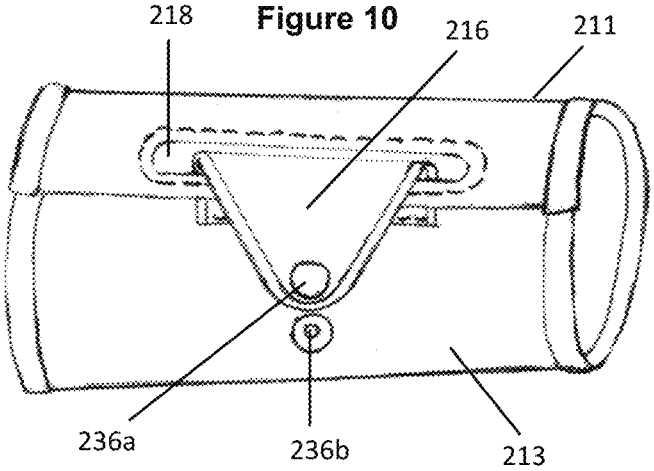
FIG. 10 is a first side-view of the third embodiment.
Figure 11:
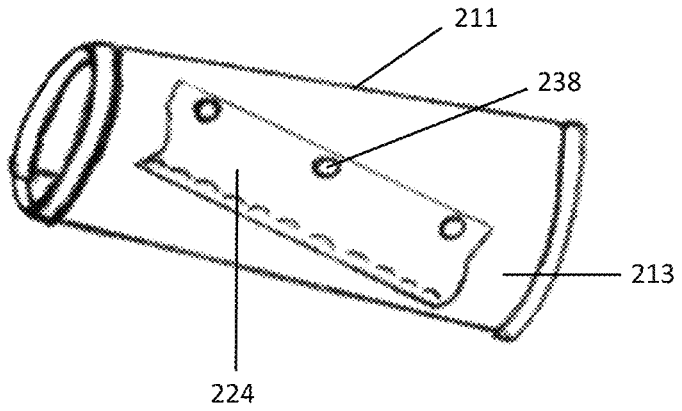
FIG. 11 is a second side-view of the third embodiment.

In a third embodiment, FIG. 9 shows a cross-sectional view like FIG. 1 whereas FIGS. 10 and 11 show a side view. The closure flap 216 is fastened to the arm band using a snap closure mechanism 236*a* and 236*b*. The cordholder 224 is fastened to the arm band using a snap closure mechanism 238*a* and 238*b*. In FIG. 9, here are three alternative mechanisms 236*b* to accommodate various forearm sizes.

FIG. 10 illustrates a similar view of the fully closed circumferential arm band 211 as FIG. 2 however closure flap 216 with snap closure mechanism 236*a* is fastened to the intermediate portion 213 of the arm band using a mating snap closure mechanism 236*b*.

FIG. 11 illustrates a similar view of the fully closed circumferential arm band 211 as FIG. 3 however the cordholder 224 is fastened to the intermediate portion 213 of the arm band using snap closure mechanism 238.

Figure 12:
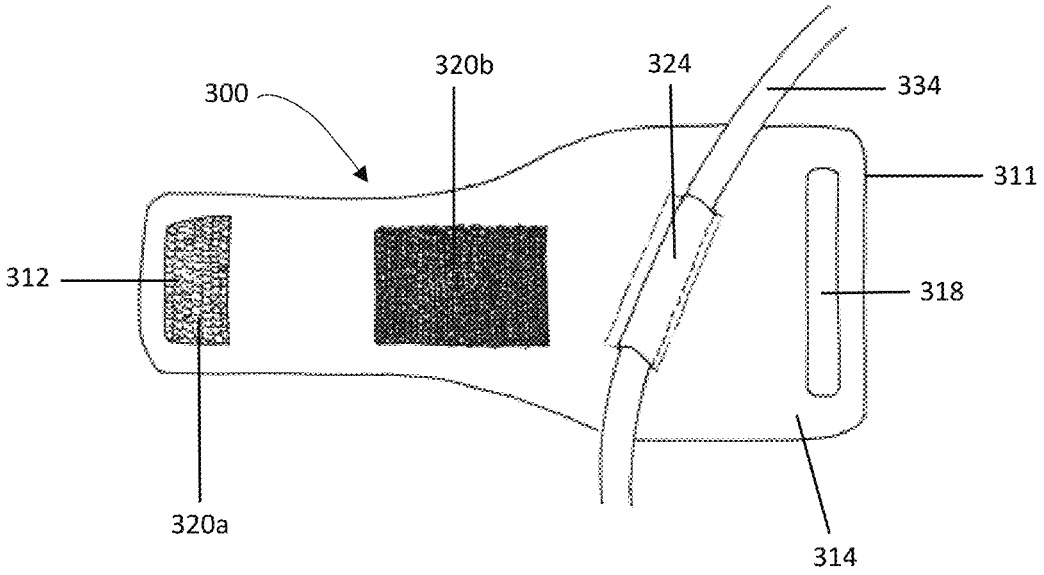
FIG. 12 shows a plan view of the fourth embodiment in an unwrapped configuration.

In a fourth embodiment, FIG. 12 shows a plan view of a support 300 comprising fully unwrapped circumferential arm band 311 with cord 334 enclosed and stabilized by cordholder 324. This embodiment depicts a tapered configuration in which the second end portion 314 is longer than the first end portion 312. Accordingly, the first end 312 is configured to couple directly with the second end 314 by sliding through the slit 318. The hook and loop closure mechanism 320*a* on the first end mates with 320*b* on the intermediate portion 313 of the arm band to close the arm band.

In some embodiments, the first end portion includes a first end, the second end portion includes a second end, and the first end and the second end are of the same length. The slit 18 extends in parallel to the axis of the wrapped version of the arm band.

The exterior or outer surface of the arm band may comprise a flexible thermoplastic polymer, thermoset polymer, or another suitable material. In some cases, the material is fibrous and/or contains a filler. In embodiments, the exterior surface is formed from a material that is water resistant or waterproof to facilitate cleaning. In some cases, the outer surface of the arm band is formed from a nylon material. In certain instances, the polymeric material is coated with a thin layer of fluid resistant material such as polyurethane to prevent absorption of moisture during use.

In embodiments, the interior surface of the arm band is lined by a thin coating of a thermosetting polymer or a thermoplastic polymer. Suitable materials include, but are not limited to, medical-grade liquid silicone rubber (LSR) configured to sustain limited exposure to the user's skin. LSR is inherently flexible, non-allergenic, water repellant, and resistant to microbial growth. In embodiments, the arm band can be washed and/or sanitized. LSR and other materials can be sterilized using several methods such as autoclave, Ethylene Oxide (EtO), and Gamma radiation.

The coefficient of friction of silicone rubber ranges from approximately 0.25 to 0.75. When applied as a top coat, cured silicone rubber reduces surface friction up to 40%, ensuring adequate grip of the arm band against the user's arm and a snug fit during use. In some embodiments, the cordholder 24, 224 is angled between 10 degrees and 50 degrees, or between 20 degrees and 40 degrees, in relation to the length direction of the radius bone in the user's forearm. The length direction corresponds to the central longitudinal axis A of the arm arm band, as shown in FIG. 4A. This directs the cord away from the user's wrist as the cord is routed back to the connected equipment. In embodiments, the cordholder 24 is on the side of the user's arm that contacts the user's torso, as is shown in FIG. 7.

The width of the arm band is defined as the distance between distal end 15 and proximal end 17. The length of the cordholder 24 typically ranges from about 10% to about 160%, or about 50% to about 150%, or about 70% to about %125%, of the width of the arm band (measured at the location cordholder is attached) to ensure that the weight of the cord is distributed across the surface area in a way that reduces stress or strain on the user's arm. In embodiments, the cordholder has a length in the range of about 2 cm to about 21 cm, or about 3 cm to about 18 cm, or about 8 cm to about 16 cm. In some embodiments, the cordholder has a length in the range of 8 cm to 21 cm, and the width of the arm band is in the range of 6.4 cm to 30 cm, or 11.4 cm to 16.8 cm.

The first embodiment provides hook and loop closure mechanisms 20 and 26 to removably locate closure flap 16 and cordholder 24. The third embodiment provides snap closure mechanisms 236 and 238 to removably locate closure flap 216 and cordholder 224. An alternative coupling to those provided includes but is not limited to a (i) belt-like closure with strap and mating buckle or (ii) shoe-lace type configuration with two mating strings.

The first embodiment provides that cordholder 24 is permanently anchored to the arm band 11. This embodiment contemplates that the cordholder is sewn onto the arm band 11 using a thread-like fiber. An alternative coupling to that provided includes but is not limited to adhering one end of the cordholder to the arm band using a liquid adhesive.

While the cordholder usually is used to support a cord, the cordholder also can support other items that connect a handheld device to another product or source.

It is specifically intended that the present invention not be limited to the embodiments and illustrations contained herein, but include modified forms of those embodiments including portions of the embodiments and combinations of elements of different embodiments as come within the scope of the following claims.

What is claimed is:

1. An arm band, comprising:

an inner surface configured to surround and contact at least a portion of a user's lower arm, and an opposite outer surface, the arm band further including a distal end portion, a proximal end portion, a central longitudinal axis extending from the distal end portion to the proximal end portion, and a fastener to support the arm band surrounding the user's arm; and a cordholder attached to the arm band, the cordholder having a length in the range of 8 cm to 21 cm, and extending diagonally relative to the central longitudinal axis of the band, and a width, the cordholder and band forming an elongated cord-receiving sleeve having two open ends, the sleeve configured to surround and support a cord utilizing the length of the cordholder rather than the width, thereby spreading the load of the cord to reduce wrist strain when the band is mounted to the user's arm, thereby providing ergonomic support.

2. The arm band of claim 1, wherein the cordholder is removable from said arm band.

3. The arm band of claim 1, wherein the proximal end portion has radius of curvature that tapers towards the distal end portion, which has a smaller radius of curvature.

4. The arm band of claim 1, wherein the distance between distal end portion and proximal end portion is in the range of about 15-33 cm.

5. The arm band of claim 1 wherein the cordholder is attached to the outer surface of the arm band.

6. The arm band of claim 1 wherein the cordholder is attached to the outer surface of the band with hook and loop fasteners, snaps, zippers, or a combination thereof.

7. The arm band of claim 1, wherein the inner surface comprises a flexible coating of a thermoset polymer, thermoplastic polymer, or a combination thereof.

8. The arm band of claim 7, wherein the outer surface comprises a material that is fluid resistant.

9. The arm band of claim 7, wherein the outer surface comprises nylon.

10. The arm band of claim 1, wherein the outer surface comprises a thin layer coating of polyurethane.

11. The arm band of claim 7, wherein the outer surface comprises a thin layer coating of polyurethane.

12. The arm band of claim 7, wherein the inner surface coating has a static coefficient of friction between 0.8 to 1.2 μs when dry to achieve grip against the user's arm.

13. The arm band of claim 1 wherein the arm band includes a first end portion and a second end portion, and the fastener includes a first closure mechanism formed on the first end portion.

14. The arm band of claim 13 wherein the arm band includes an intermediate portion, and the fastener includes a mating closure mechanism formed on the intermediate portion to which the first closure mechanism may fasten.

15. The arm band of claim 13 wherein the fastener includes a mating closure mechanism on the second end portion to which the first closure mechanism may fasten.

16. The arm band of claim 13 wherein the second end portion of the arm band includes a slit configured to receive the first end portion of the arm band to fasten the arm band around the circumference of the user's arm.

17. The arm band of claim 13 wherein the first closure mechanism, and a mating closure mechanism formed on a second end portion of the arm band, are configured to support the arm band around and in contact with user's arms of various sizes.

18. The arm band of claim 1 wherein the cordholder is angled between 10 and 50 degrees in relation to the central longitudinal axis of the arm band when the arm band is mounted on the user's arm and a cord is mounted in the cordholder.

* * * * *